US009187981B2

(12) United States Patent
Ocalan et al.

(10) Patent No.: US 9,187,981 B2
(45) Date of Patent: Nov. 17, 2015

(54) WIRELINE TOOL CONFIGURATIONS HAVING IMPROVED RETRIEVABILITY

(71) Applicant: Schlumberger Technology Corporation, Sugar Land, TX (US)

(72) Inventors: Murat Ocalan, Houston, TX (US); Jahir Pabon, Newton, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 457 days.

(21) Appl. No.: 13/666,475

(22) Filed: Nov. 1, 2012

(65) Prior Publication Data

US 2014/0116675 A1 May 1, 2014

(51) Int. Cl.

| | |
|---|---|
| ***E21B 31/00*** | (2006.01) |
| ***E21B 41/00*** | (2006.01) |
| ***E21B 23/14*** | (2006.01) |
| ***E21B 47/00*** | (2012.01) |
| ***E21B 17/07*** | (2006.01) |

(52) U.S. Cl.

CPC ..... *E21B 41/00* (2013.01); *E21B 17/07* (2013.01); *E21B 23/14* (2013.01); *E21B 31/00* (2013.01); *E21B 47/00* (2013.01)

(58) Field of Classification Search

CPC ..... E21B 23/006; E21B 23/004; E21B 17/07; E21B 17/073; E21B 31/00; E21B 31/107; E21B 31/113; E21B 31/005

See application file for complete search history.

(56) References Cited

U.S. PATENT DOCUMENTS

| | | | | |
|---|---|---|---|---|
| 1,612,889 | A * | 1/1927 | Smith | 175/57 |
| 3,703,104 | A * | 11/1972 | Tamplen | 74/88 |
| 4,736,797 | A | 4/1988 | Restarick, Jr. et al. | |
| 5,117,685 | A * | 6/1992 | Goldschild | 73/152.55 |
| 5,309,405 | A | 5/1994 | Brett et al. | |

(Continued)

OTHER PUBLICATIONS

Dictionary definition of "groove" accessed Jun. 22, 2015 via www.merriam-webster.com.*

(Continued)

*Primary Examiner* — Blake Michener
*Assistant Examiner* — Kipp Wallace
(74) *Attorney, Agent, or Firm* — Kenneth L. Kincaid; Cathy Hewitt

(57) ABSTRACT

A first wireline tool embodiment includes a segmented tool body having a joint deployed between each adjacent pair of tool body sections. The joint may be configured to extend axially (causing a relative axial displacement of the adjacent tool body sections) when the wireline tool is subject to an axial load. The joint may include, for example, a compliant joint or a protractible joint. The joint may be further configured to cause a relative rotation between the adjacent tool body sections when the wireline tool is subject to axial load. A second wireline tool embodiment includes a plurality of standoff rings deployed about an outer surface of a rigid tool body. The standoff rings engage helical grooves in the outer surface of the tool body such that axial displacement of the tool body causes the standoff rings to rotate.

16 Claims, 5 Drawing Sheets

(56) References Cited

U.S. PATENT DOCUMENTS

| | | | | |
|---|---|---|---|---|
| 5,454,420 | A * | 10/1995 | Snider et al. | 166/381 |
| 7,637,321 | B2 | 12/2009 | Zazovsky et al. | |
| 7,690,423 | B2 | 4/2010 | Del Campo et al. | |
| 7,703,318 | B2 | 4/2010 | Jacobson et al. | |
| 7,849,924 | B2 * | 12/2010 | Surjaatmadja et al. | 166/298 |
| 7,894,297 | B2 | 2/2011 | Nutt et al. | |
| 2006/0185905 | A1 * | 8/2006 | Haughom | 175/321 |
| 2011/0139510 | A1 * | 6/2011 | Declute-Melancon | 175/53 |
| 2012/0018145 | A1 | 1/2012 | Wheater et al. | |
| 2012/0031609 | A1 | 2/2012 | Wheater et al. | |
| 2013/0062075 | A1 | 3/2013 | Brennan, III | |

OTHER PUBLICATIONS

Dupriest, et al. "Design Methodology and Operational Practices Eliminate Differential Sticking," IADC/SPE 128129; 2010 IADC/SPE Drilling Conference and Exhibition, pp. 1-13.

Parry "Numerical Prediction Method for Growth and Deformation of Filter Cakes," Journal of Fluids Engineering, Nov. 2006, Vol, 128, pp. 1259-1265.

Sherwood "Differential Pressure Sticking of Drill String," AIChE Journal, vol. 44, No. 3, Mar. 1998, pp. 711-721.

* cited by examiner

WIRELINE TOOL CONFIGURATIONS HAVING IMPROVED RETRIEVABILITY

CROSS REFERENCE TO RELATED APPLICATIONS

None.

FIELD OF THE INVENTION

Disclosed embodiments relate generally to a downhole tools configured to have improved retrievability in differential sticking environments. More particularly, certain of the disclosed embodiments relate to a downhole tool including a segmented tool body in which the body segments are connected to one another via compliant and/or protractible joints that enable adjacent segments to translate with respect to one another. Other disclosed embodiments relate to a downhole tool including at least first and second standoff rings deployed about a rigid tool body.

BACKGROUND INFORMATION

The interaction force between the borehole wall and wireline tools or other downhole tools can become significant as a result of differential sticking phenomena. During open-hole wireline operations, the wellbore is typically pressurized above the formation pore pressure in order to prevent formation fluids from entering the wellbore. At such pressures drilling fluids may flow into permeable formations. Solid particles in the drilling fluids are often too large to enter the fine pore structure of the formation and remain on the borehole wall. These filtered particles are commonly referred to as mud cake or filter cake in the art.

When a wireline tool (or a drilling tool) contacts the mud cake, the fluid pressure on the borehole side of the tool often exceeds the fluid pressure on the formation side of the tool. This differential pressure may cause the tool to stick (or adhere) to the borehole wall. Such differential sticking can be problematic. For example, large axial forces are sometimes required to dislodge the tool from the borehole wall. In extreme cases, the magnitude of the force may exceed the maximum force that the wireline cable can carry. In such cases expensive and time consuming fishing operations (or other remedial operations) may be required to remove the tool from the wellbore.

There remains a need in the art for downhole tools that allow for easier retrieval in operations in which differential sticking is an issue.

SUMMARY

Wireline tool configurations are disclosed that may have improved retrievability in differential sticking conditions. In certain embodiments, the disclosed wireline tools include a segmented tool body including a joint deployed between each adjacent pair of tool body sections. The joint is configured to extend axially (causing a relative axial displacement of the adjacent tool body sections) when the wireline tool is subject to an axial load. The joint may include, for example, a compliant joint or a protractible joint. The joint may be further configured to cause a relative rotation between the adjacent tool body sections when the wireline tool is subject to axial load. In an alternative tool embodiment, standoff rings are deployed about an outer surface of a rigid tool body. The standoff rings engage helical grooves in the outer surface of the tool body such that axial displacement of the tool body with respect to the standoff rings causes the rings to rotate.

The disclosed embodiments may provide various technical advantages. For example, the disclosed embodiments are intended to reduce the axial force required to draw a downhole tool to the surface when differential sticking phenomenon are present. The disclosed tool embodiments may increase the shear stress in the mud cake, for example, via decreasing the surface area of the tool/mud cake interface across which the axial force acts or via introducing rotational motion to the differentially stuck component.

In one aspect, a downhole wireline tool is disclosed. The tool includes a tool body including a plurality of axially spaced substantially rigid tool body sections and a joint deployed axially between each axially adjacent pair of tool body sections. The joint is configured to extend in an axial direction thereby causing a first of the axially adjacent pair of tool body sections to translate with respect to a second of the axially adjacent pair of tool body sections when the wireline tool is subject to an axial load.

In another aspect, a downhole wireline tool is disclosed. The wireline tool includes a tool body including first and second axially spaced substantially rigid tool body sections and a protractible joint deployed axially between the first and second tool body sections. The joint is configured to extend in an axial direction thereby causing the first tool body section to translate with respect to the second tool body section when the wireline tool is subject to an axial load. The translation between the first and second tool body sections further causes a relative rotation of the first tool body section with respect to the second tool body section.

In a further aspect, a downhole wireline tool is disclosed. The wireline tool includes a rigid tool body and first and second standoff rings deployed about the tool body. The first standoff ring engages a first set of helical grooves in an outer surface of the tool body such that relative axial motion of the tool body in a first direction with respect to the first standoff ring causes the first standoff ring to rotate about the tool body in a clockwise direction. The second standoff ring engages a second set of helical grooves in an outer surface of the tool body such that relative axial motion of the tool body in the first direction with respect to the second standoff ring causes the second standoff ring to rotate about the tool body in a counterclockwise direction.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

For a more complete understanding of the disclosed subject matter, and advantages thereof, reference is now made to the following descriptions taken in conjunction with the accompanying drawings, in which.

DETAILED DESCRIPTION

Figure 1:
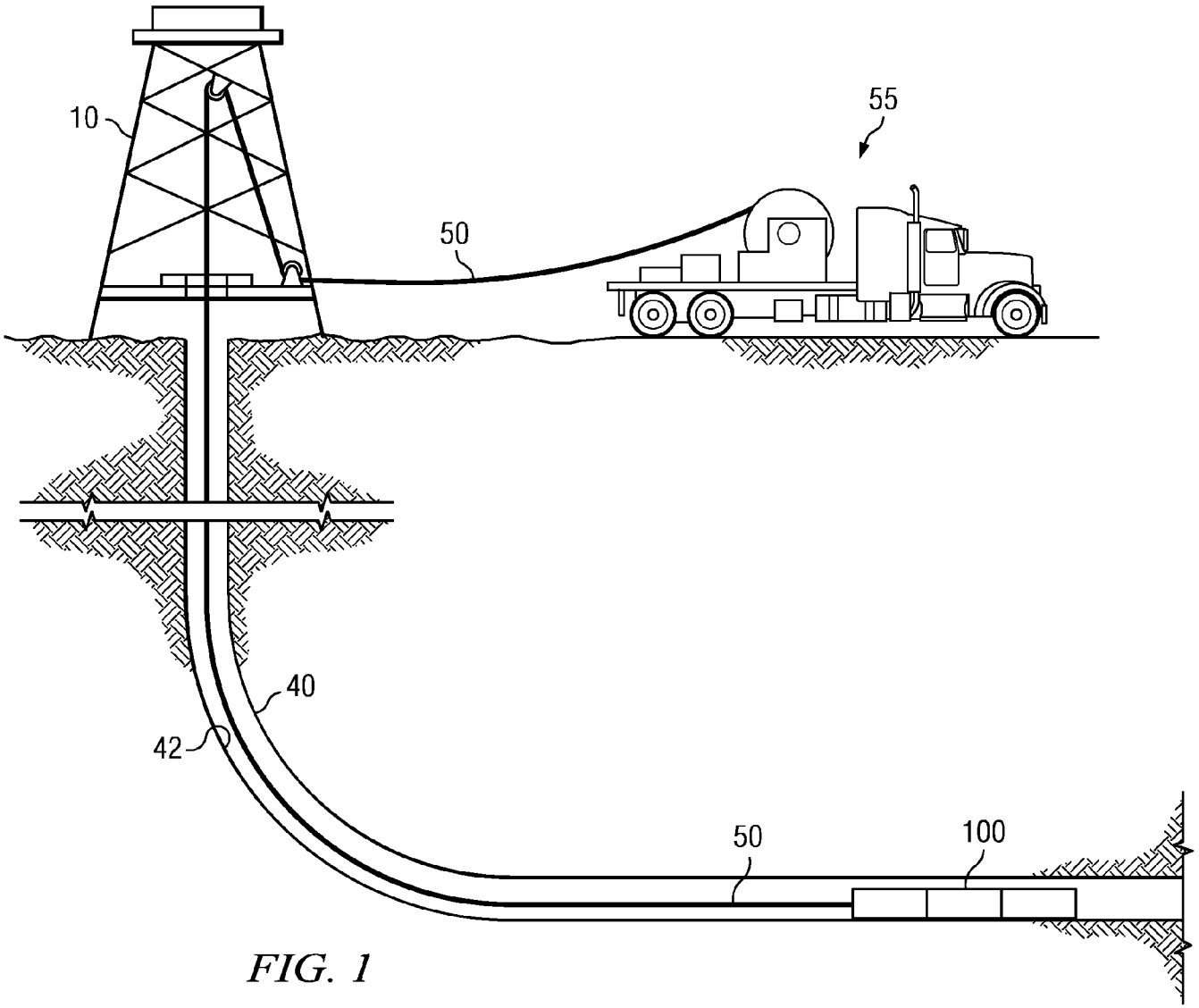
FIG. 1 depicts one example of a drilling rig on which disclosed tool embodiments may be utilized.

FIG. 1 depicts a drilling rig 10 suitable for employing certain wireline tool embodiments disclosed herein. In the depiction, a rig 10 is positioned over (or in the vicinity of) a subterranean oil or gas formation. The rig may include, for example, a derrick and a hoisting apparatus for lowering and raising various components into and out of the wellbore 40. A downhole wireline measurement tool 100 is deployed in borehole 40. The measurement tool may be connected to the surface, for example, via a wireline cable 50 which is in turn coupled to a wireline truck 55.

During a wireline operation, downhole tool 100 may be lowered into the borehole 40. In a highly deviated borehole, the downhole tool 100 may alternatively or additionally be driven or drawn into the borehole using, for example, a downhole tractor or other conveyance means. The disclosed embodiments are not limited in this regard. For example, downhole tool 100 may also be conveyed into the borehole 40 using coiled tubing or drill pipe conveyance methodologies.

Downhole tool 100 may include substantially any suitable wireline or slick line tool. For example, downhole tool 100 may include a wireline logging tool, a wireline surveying tool, or a wireline formation fluid sampling tool. Although not depicted in the FIGS., such tools may include one or more of various sensors, for example, including accelerometers, magnetometers (or other magnetic field sensors), gyroscopic sensors, gamma ray sensors, neutron sensors, density sensors, resistivity antennae, microresistivity electrodes, ultrasonic transducers, audible acoustic sensors, pressure sensors, and the like. It will be understood that the disclosed embodiments are not limited to any particular sensor configuration or even to the use of a sensor or a wireline tool configuration.

In the FIG. 1 depiction, downhole tool 100 is shown to be contacting the borehole wall 42. As described above in the Background Section, differential sticking phenomena can cause downhole tools to become adhered to the borehole wall. In some instances large axial forces are required to overcome the differential sticking forces. The embodiments disclosed herein and described in more detail below are intended to reduce the forces required to remove stuck tools.

Figure 2A:
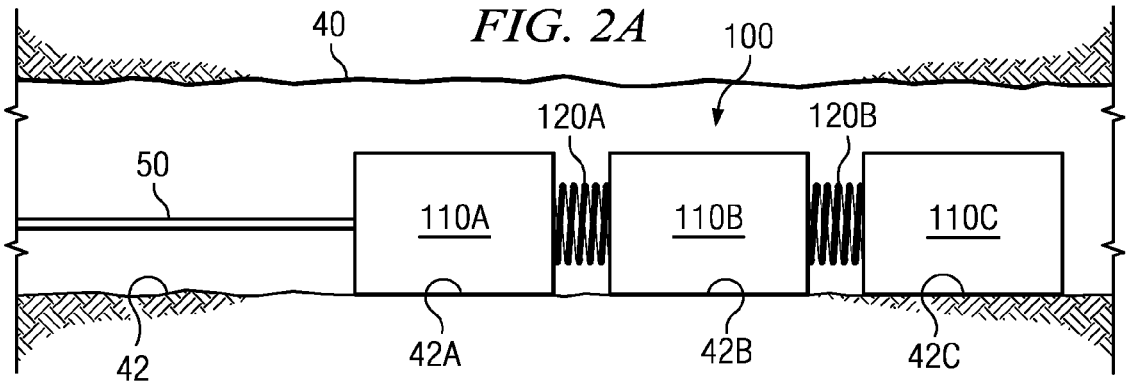
FIGS. 2A, 2B, and 2C depict one example of a disclosed tool embodiment deployed in a subterranean wellbore, with FIG. 2A depicting the tool in a collapsed configuration, FIG. 2B depicting the tool in a partially expanded configuration, and FIG. 2C depicting the tool in a fully expanded configuration.
Figure 2B:
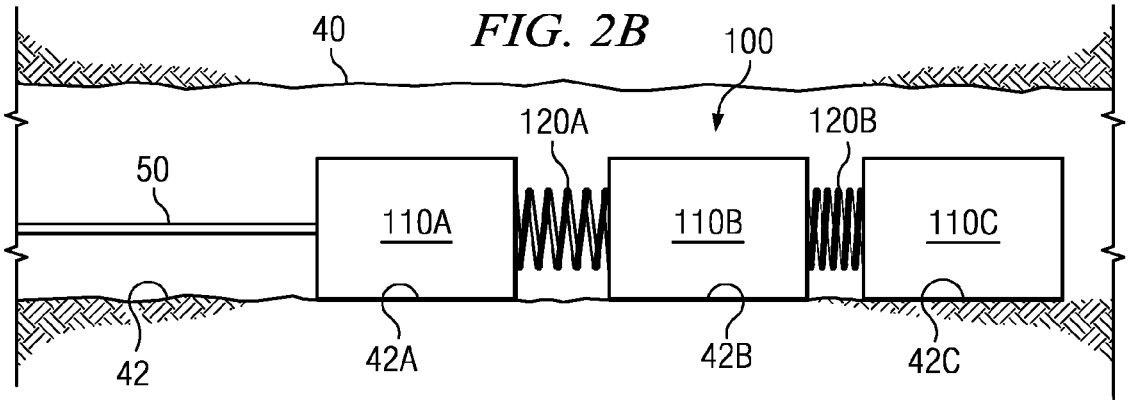
Figure 2C:
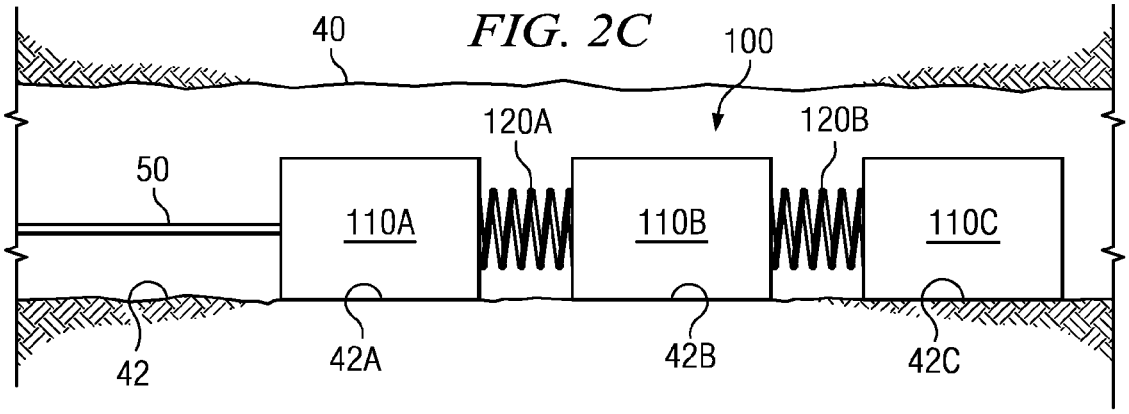

FIGS. 2A, 2B, and 2C depict one example of downhole tool 100 deployed in a subterranean wellbore 40, with FIG. 2A depicting the tool 100 in a collapsed configuration, FIG. 2B depicting the tool 100 in a partially expanded configuration, and FIG. 2C depicting the tool 100 in a fully expanded configuration. In each configuration, the downhole tool 100 is shown contacting the borehole wall 42. In the depicted embodiment, downhole tool 100 includes first, second, and third substantially rigid tool body sections (or segments) 110A, 110B, and 110C connected to one another via first and second compliant tool joints 120A and 120B. Compliant joint 120A is deployed axially between first and second tool body sections 110A and 110B and compliant joint 120B is deployed axially between second and third tool body sections 110B and 110C.

In the depicted embodiments, compliant joints 120A and 120B are schematically depicted in the form of a spring. Such a depiction is merely an example and is meant to be representative of the compliant joints 120A and 120B being configured to lengthen elastically under axial load (for example, when tool 100 is urged towards the surface via an axial load on wireline cable 50). This may be accomplished, for example, via fabricating the compliant joints 120A and 120B using a material of construction having a reduced elastic modulus as compared to the tool body or constructing the downhole tool 100 such that the compliant joints 120A and 120B have a reduced cross sectional area as compared to the tool body sections 110A, 110B, and 110C. The compliant joints may also include spring members sized and shaped to lengthen at axial loads above some predetermined threshold load. The tool body sections are referred to as substantially rigid tool body sections to indicate that the lengthening of the tool body sections under axial load is insignificant compared to the lengthening of the compliant joints.

Compliant joints 120A and 120B may be configured such that they have a compliance that is greater than the compliance of the remainder of the downhole tool. Stated another way the compliance of the compliant joints 120A and 120B may be greater than the compliance of the tool body sections 110A, 110B, and 110C (individually or collectively). Those of ordinary skill in the art will readily appreciate that compliance is the inverse of stiffness. Thus, the compliant joints 120A and 120B may be configured so as to have a stiffness less than that of the tool body sections 110A, 110B, and 110C (individually or collectively).

In FIG. 2A the compliant joints 120A and 120B are depicted as being substantially fully collapsed. This may occur, for example, when the axial force on the tool is low (e.g., below a threshold). In normal downhole operations (i.e., when there is little or no differential sticking), the compliant joints 120A and 120B remain substantially fully collapsed while the downhole tool 100 is drawn towards the surface. When the tool becomes stuck in the wellbore, for example, due to the aforementioned differential sticking phenomena, increased axial force is required to shear the mud cake. As the axial force is increased (e.g., above some threshold), compliant joint 120A begins to lengthen (via elastic deformation) such that tool body section 110A translates axially with respect to tool body section 110B. As a result, the tension in the wireline cable 50 is carried primarily by the mud cake in contact with tool body section 110A (depicted at 42A). The increased shear stress in this region of the mud cake (due to the decreased surface area of the mud cake across which the axial force acts) enables tool body section 110A to be released more effectively.

In FIG. 2B compliant joint 120A is extended while compliant joint 120B remains substantially fully collapsed. As tool body section 110A is released (due to the shearing of the mud cake 42A in contact therewith) and as the compliant joint 120A becomes fully extended (e.g., against a stop—not shown), the tension in the wireline cable 50 is conveyed to tool body section 110B. The tension is then carried primarily by the mud cake 42B in contact with tool body section 110B which enables tool body section 110B to be released in the same manner as tool body section 110A. This process continues sequentially until the tool is fully released (e.g., as depicted on FIG. 2C in which both compliant joints 120A and 120B are extended and in which the mud cake at 42A, 42B, and 42C has been sheared).

Figure 3A:
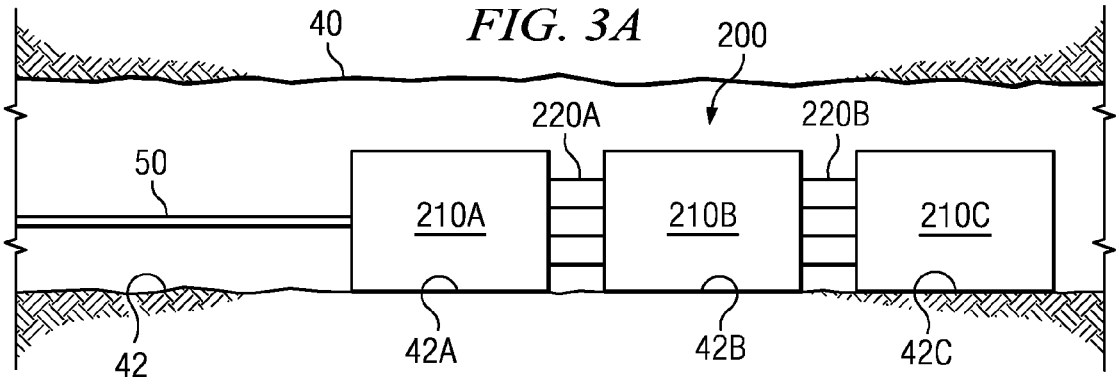
FIGS. 3A, 3B, and 3C depict another example of a disclosed tool embodiment deployed in a subterranean wellbore, with FIG. 3A depicting the tool in a collapsed configuration, FIG. 3B depicting the tool in a partially expanded configuration, and FIG. 3C depicting the tool in a fully expanded configuration.
Figure 3B:
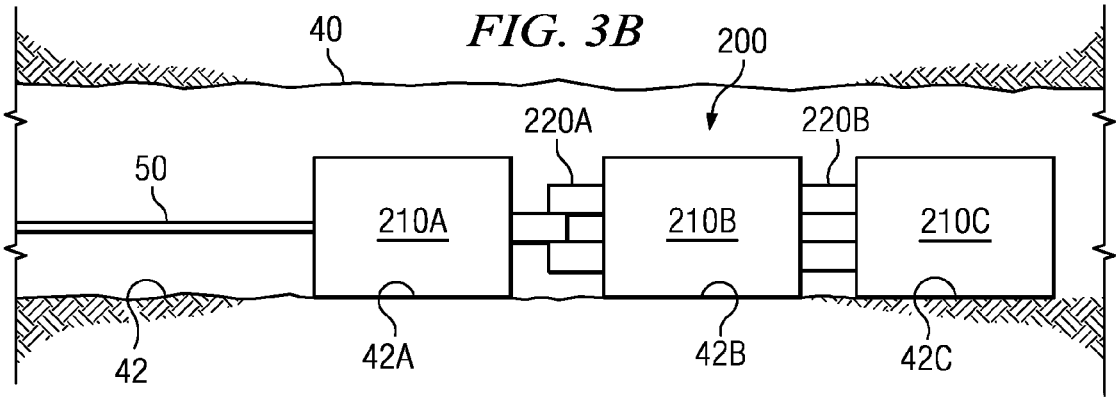
Figure 3C:
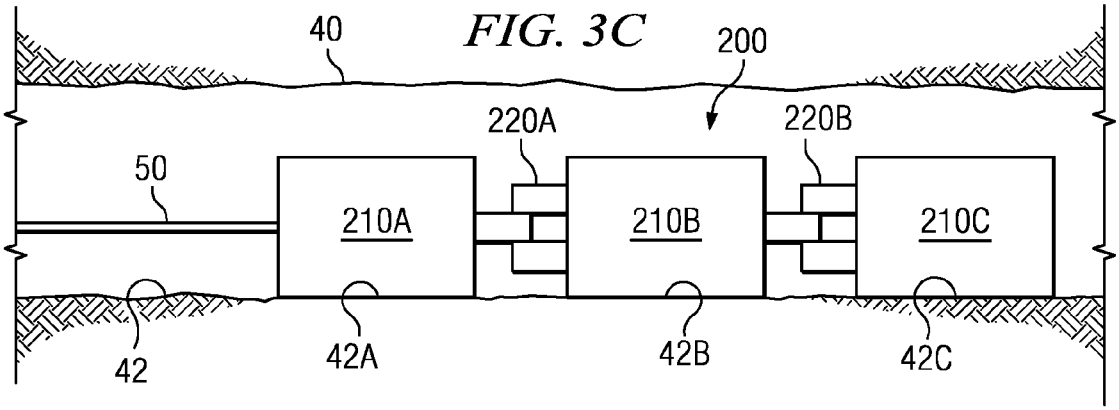

FIGS. 3A, 3B, and 3C depict another example of a downhole tool 200 deployed in a subterranean wellbore 40, with FIG. 3A depicting the tool 200 in a collapsed configuration, FIG. 3B depicting the tool 200 in a partially expanded configuration, and FIG. 3C depicting the tool in a fully expanded configuration. In each configuration, the downhole tool 200 is shown contacting the borehole wall 42. The depicted embodiment of downhole tool 200 is similar to downhole tool 100 (FIGS. 2A, 2B, and 2C) in that it includes first, second, and third tool substantially rigid body sections 210A, 210B, and 210C connected to one another via first and second protractible tool joints 220A and 220B. Protractible joint 220A is deployed axially between first and second tool body sections 210A and 210B and protractible joint 220B is deployed axially between second and third tool body sections 210B and 210C.

In FIG. 3A the protractible joints 220A and 220B are depicted as being substantially fully collapsed. The protractible joints may be secured in the collapsed position, for example, via shear pins or electrically actuated latches (not shown). In normal downhole operations (i.e., when there is little or no differential sticking), the protractible joints 220A and 220B remain substantially fully collapsed while the tool 100 is drawn towards the surface. When the tool becomes stuck in the wellbore, for example, due to the aforementioned differential sticking phenomena, increased axial force is required to shear the mud cake. In embodiments that utilize shear pins to secure the protractible joints in the collapsed position, an axial force above a predetermined threshold is required to shear the pins and enable the protractible joints to extend. In embodiments that utilize electrically actuated latches, the latches may be released upon the detection of differential sticking (e.g., increased force requirements on the wireline cable 50).

As the axial force is increased (for example during a wireline measurement operation) protractible joint 220A begins to lengthen (e.g., after breaking a shear pin) such that tool body section 110A axially translates with respect to tool body section 110B. As a result, the tension in the wireline cable 50 is carried primarily by the mud cake in contact with tool body section 210A. The increased shear stress in this region of the mud cake (due to the decreased surface area of the mud cake across which the axial force acts) enables tool body section 210A to be released more effectively. In FIG. 3B protractible joint 220A is extended while compliant joint 220B remains substantially fully collapsed. As tool body section 210A is released (due to the shearing of the mud cake 42A in contact therewith) and as the protractible joint 220A becomes fully extended (e.g., against a stop—not shown), the tension in the wireline cable 50 is conveyed to tool body section 210B. The tension is then carried primarily by the mud cake 42B in contact with tool body section 210B which enables tool body section 210B to be released in the same manner as tool body section 210A. This process continues sequentially until the tool is fully released (e.g., as depicted on FIG. 3C in which both protractible joints 220A and 220B are fully extended and in which the mud cake at 42A, 42B, and 42C has been sheared).

Figure 4A:
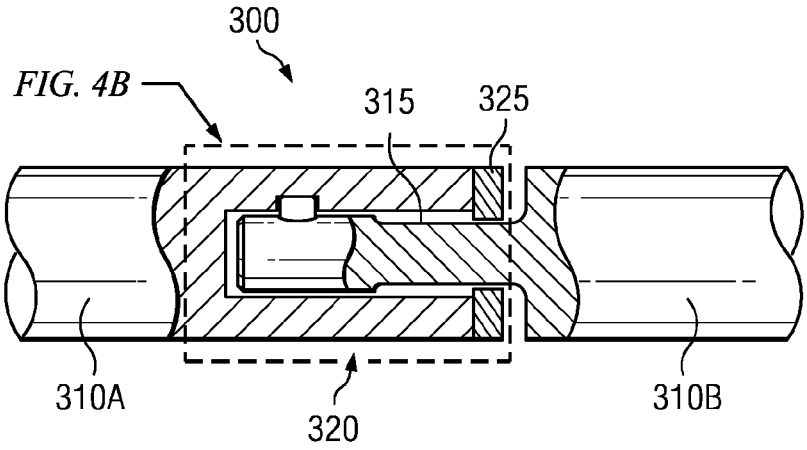
FIGS. 4A, 4B, and 4C depict still another disclosed tool embodiment including a protractible joint configured to convert relative linear motion to relative rotational motion.
Figure 4B:
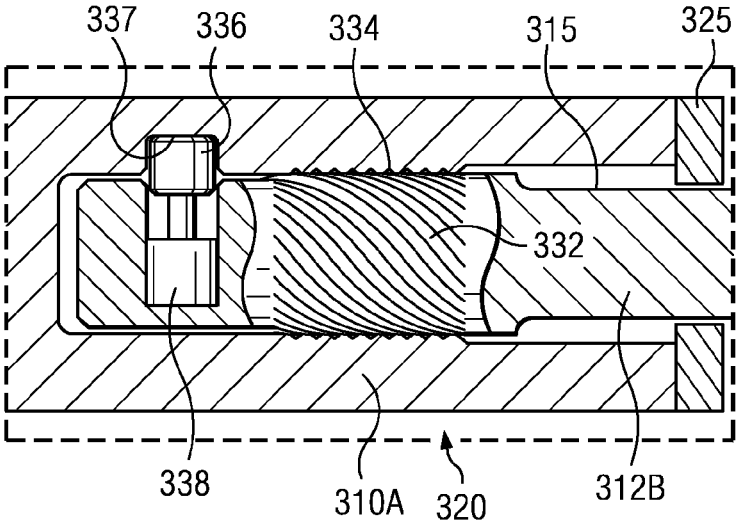
Figure 4C:
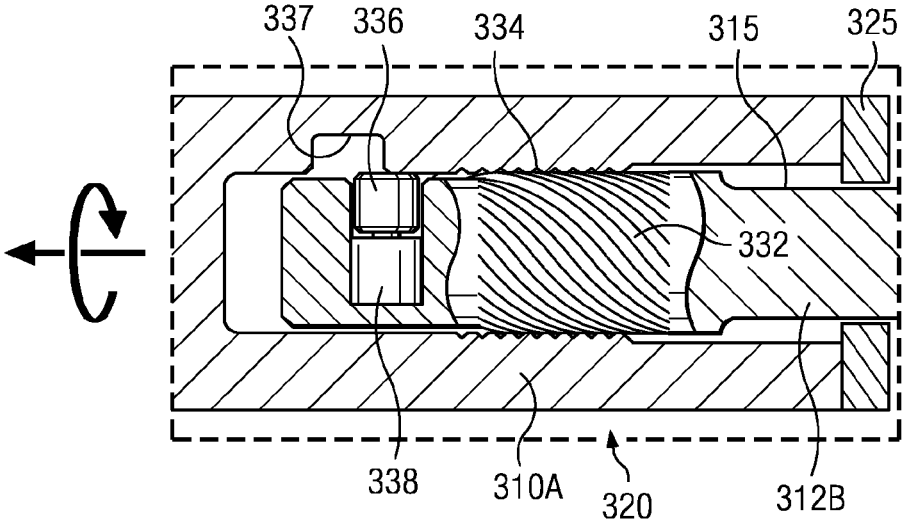

FIGS. 4A, 4B, and 4C depict still another disclosed tool embodiment 300 including a protractible joint 320 configured to convert relative axial motion to relative rotational motion. In the depicted embodiment downhole tool 300 includes first and second substantially rigid tool body sections 310A and 310B connected to one another via protractible joint 320. Protractible joint 320 differs from protractible joints 220A and 220B (FIGS. 3A, 3B, and 3C) in that it provides for both relative axial and relative rotational motion between tool body sections 310A and 310B. Tool body section 310B includes a threaded pin 312B sized and shaped to engage a corresponding threaded end in tool body section 310A. The pin 312B is configured to axially reciprocate between first and second axial positions in the tool body section 310A (FIG. 4B depicts the pin in the first position while FIG. 4C depicts the pin translating from the first position towards the second position). In the first (fully inserted) position depicted on FIG. 4B, a latch 336 deployed on the pin 312B is engaged with a corresponding slot 337 in the tool body section 310A. Engagement of the latch 336 with the slot 337 both axially and rotationally couples the first and second tool body sections 310A and 310B to one another. Radial retraction of the latch 336 into the pin 312B (as depicted on FIG. 4C) axially decouples the first and second tool body portions 310A and 310B allowing the pin 312B to be retracted towards the second position (as depicted on FIG. 4C) when the tool is subject to an axial load. In the second position (not depicted) shoulder 315 on the pin 312B abuts stop 325.

As is further depicted on FIGS. 4A, 4B, and 4C, pin 312B includes high pitch angle reciprocal threads 332 sized and shaped for engagement with corresponding threads 334 in the recess of the tool body section 310A. By reciprocal it is meant that the threads are non self locking such that an axial load acting to separate the first and second tool body sections 310A and 310B causes a relative rotation of the tool body section 310A with respect to tool body section 310B as the threads 332 slide past corresponding threads 334 (referred to as thread overhaul in the mechanical arts). It will be understood by those of ordinary skill in the art that most threads are self-locking such that no amount of axial force will cause relative rotation. Whether a thread is self-locking or reciprocal depends on the pitch angle of the thread and the coefficient of friction between the threads. Lubricated high pitch angle threads may be reciprocal (non self locking). The depicted embodiments are not limited to any particular pitch angle. In embodiments in which the threads are highly lubricated the pitch angle need only be high enough to allow thread overhaul at axial forces commonly employed downhole.

In normal downhole operations (i.e., when there is little or no differential sticking), latch 336 is radially extended (as depicted in FIG. 4B) into slot 337 thereby axially coupling the first and second tool body sections 310A and 310B to one another. When differential sticking is observed (e.g., via an increase in the axial force required to draw the tool towards the surface), the latch may be collapsed into the pin 312B, for example, via an electrically powered actuator 338, thereby axially and rotationally decoupling the first and second tool body sections 310A and 310B. When under axial load, retraction of the latch 336 (as in FIG. 4C) allows tool body section 310A to translate and rotate with respect to tool body section 310B as described above (i.e., via thread overhaul). The rotational motion further increases the shear stress on the mud cake in contact with tool body section 310A thereby causing tool body section 310A to be released more effectively. After tool body section 310A has been released and protractible joint 320 has been fully extended (e.g., such that shoulder 315 abuts stop 325), tension from the wireline cable is transferred to tool body section 310B enabling tool body section 310B to be released in the same manner as described above.

It will be understood that the tool embodiments described above with respect to FIGS. 2A through 4C are not limited to first and second or first, second, and third tool body sections. Suitable tool embodiments may include substantially any plurality of tool body sections (connected to one another via the aforementioned compliant or protractible joints) depending on the particular downhole operation. Moreover, the tool body sections (segments) may include substantially any number of functional tool modules as adjacent functional modules are not necessarily separated by the disclosed compliant or protractible joints. It will be further understood that FIGS. 2A through 4C are not drawn to scale and that the relative axial motion between adjacent tool body sections is exaggerated in the depicted embodiments in order to more clearly point out various features of these embodiments. In practical embodiments, the lengthening of the compliant or protractible joints is small relative to the overall tool length and the length of the individual tool body sections. For example, the lengthening of the joints (and therefore the relative axial displacement between adjacent tool body sections) may be on the order of from about a millimeter to a few centimeters. The number and location of the joints (or standoffs as described in more detail below) as well as the relative joint displacement may depend on operational considerations and may be evaluated, for example, during tool design and operational planning.

Figure 5A:
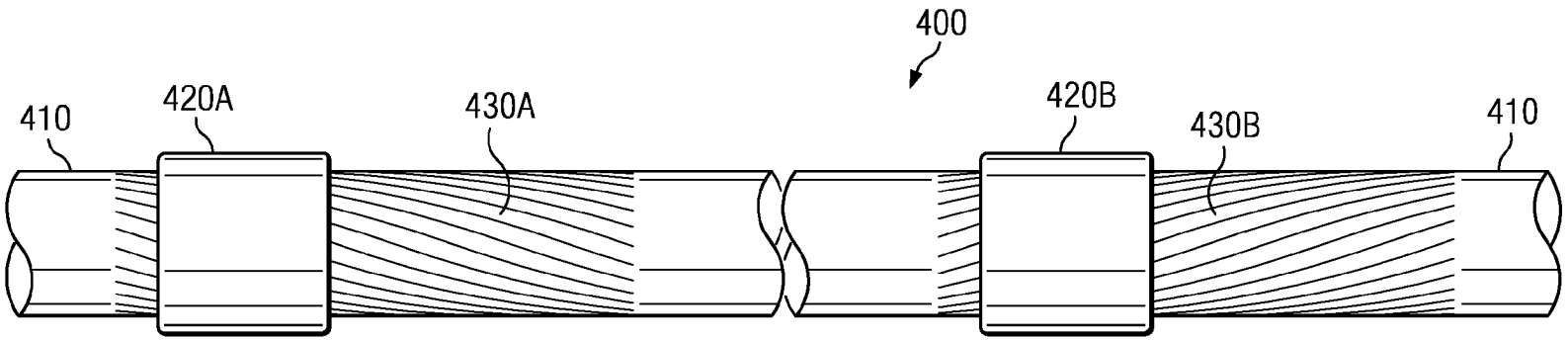
FIGS. 5A and 5B depict yet another disclosed tool embodiment including first and second standoff rings configured to rotate in opposite directions.
Figure 5B:
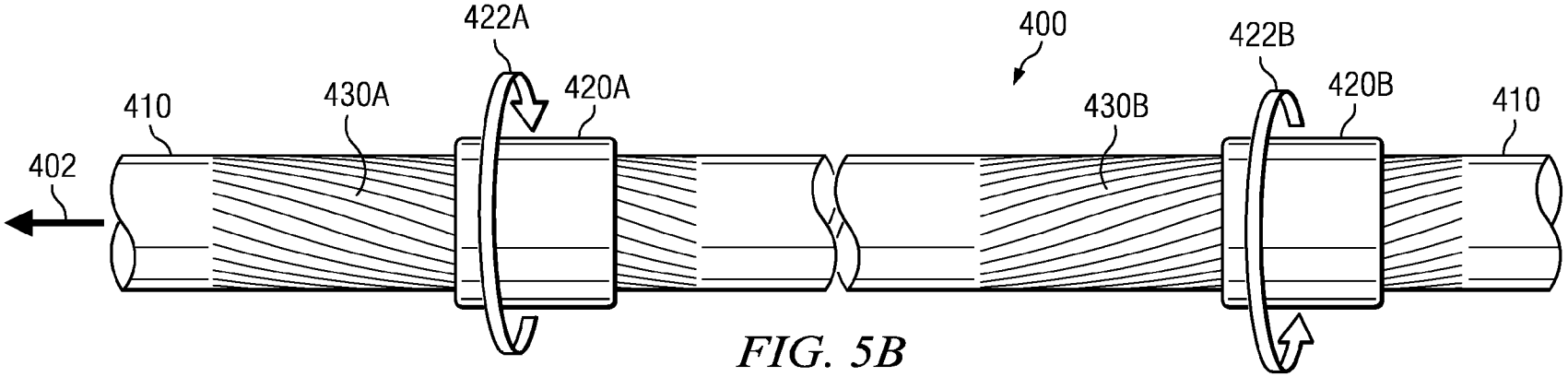

FIGS. 5A and 5B depict yet another disclosed tool embodiment 400 including first and second standoff rings 420A and 420B deployed about a substantially rigid downhole tool body 410. Having a rigid tool body 410, tool embodiment 400 may be useful in downhole operations in which various constraints militate against the use of compliant or protractible joints. Such constraints may include, for example, a need to route hydraulic or electric lines along the full length of the tool body 410.

While the tool embodiment 400 disclosed on FIGS. 5A and 5B depicts first and second standoff rings 420A and 420B, it will be understood that downhole tool 400 may also include three or more standoff rings deployed about the tool body. For example, downhole tool 400 may include at least first, second, third, and fourth standoff rings engaging corresponding first, second, third, and fourth sets of helical grooves in the outer surface of the tool body with adjacent ones of the standoff rings being configured to rotate in opposite directions with respect to the tool body.

Although not shown, standoff rings 420A and 420B include internal helical grooves (or threads) sized and shaped to engage corresponding helical grooves 430A and 430B on the tool body 410 such that relative axial motion of the standoff rings 420A and 420B with respect to the tool body 410 causes a corresponding relative rotational motion. The standoff rings may optionally be spring biased towards one end of the grooves 430A and 430B (e.g., the uphole end of the grooves as in the depicted embodiment).

During a downhole operation the standoff rings 420A and 420B are intended to contact the borehole wall and thereby reduce contact forces between the tool body 410 and the borehole wall. In differential sticking conditions, the standoff rings 420A and 420B are susceptible to differential sticking (since the standoff rings contact the borehole wall). Contact of the standoff rings 420A and 420B with the borehole wall may further reduce differential sticking forces between the tool body 410 and the borehole wall. When an axial force 402 of sufficient magnitude is applied to the tool body 410 (e.g., via a wireline cable), the tool body 410 may move axially uphole relative to the standoff rings 420A and 420B which remain substantially axially fixed with respect to the borehole owing to the differential sticking. As indicated in FIG. 5B, relative axial motion of the tool body 410 with respect to the standoff rings 420A and 420B causes the standoff rings 420A and 420B to rotate (both with respect to the borehole and the tool body 410) as indicated at 422A and 422B. Disclosed embodiments include at least a first standoff ring/helical groove combination 420A, 430A configured to cause a clockwise rotation 422A of the standoff ring (when looking down the borehole) as the tool body is drawn towards the surface and at least a second standoff ring/helical groove combination 420B, 430B configured to cause a counterclockwise rotation 422B of the standoff ring as the tool body is drawn towards the surface. The rotation of the standoff rings 420A and 420B with respect to the borehole wall is intended to shear the mud cake and thereby release the tool 400 from differential sticking.

While not depicted, tool embodiment 400 may include a stop mechanism to prevent the standoff rings 420A and 420B from axially translating outside a predetermined range of motion. For example, the standoff rings 420A and 420B may be configured to translate between first and second axial positions within the helical grooves. The stop mechanism may be configured to prevent translation beyond the first and second axial positions (e.g., out of engagement with the helical grooves).

Although wireline tool embodiments and certain advantages thereof have been described in detail, it should be understood that various changes, substitutions and alternations can be made herein without departing from the spirit and scope of the disclosure as defined by the appended claims.

What is claimed is:

1. A downhole wireline tool comprising:

a rigid tool body;

a first standoff ring deployed about the tool body and engaging a first set of helical grooves in an outer surface of the tool body such that relative axial motion of the tool body in a first direction with respect to the first standoff ring causes the first standoff ring to rotate about the tool body in a clockwise direction; and a second standoff ring deployed about the tool body and engaging a second set of helical grooves in the outer surface of the tool body such that relative axial motion of the tool body in the first direction with respect to the second standoff ring causes the second standoff ring to rotate about the tool body in a counterclockwise direction.

2. The downhole tool of claim 1, wherein axially adjacent ones of the standoff rings are configured to rotate in opposite directions with respect to the tool body.

3. The downhole tool of claim 1, comprising at least first, second, third, and fourth standoff rings engaging corresponding first, second, third, and fourth sets of helical grooves in the outer surface of the tool body, adjacent ones of the standoff rings configured to rotate in opposite directions with respect to the tool body.

4. The wireline tool of claim 1, further comprising a stop mechanism configured to prevent the first and second standoff rings translating out of engagement with the first and second sets of helical grooves.

5. The wireline tool of claim 1, comprising:

a third set of helical grooves disposed in an inner surface of the first standoff ring, wherein the third set of helical grooves is configured to engage the first set of helical grooves in the outer surface of the tool body; and a fourth set of helical grooves disposed in an inner surface of the second standoff ring, wherein the fourth set of helical grooves is configured to engage the second set of helical grooves in the outer surface of the tool body.

6. The wireline tool of claim 1, comprising:

a first biasing mechanism disposed in the first standoff ring, wherein the first biasing mechanism is configured to bias the first standoff ring towards a first end of the first set of helical grooves; and a second biasing mechanism disposed in the second standoff ring, wherein the second biasing mechanism is configured to bias the second standoff ring towards a first end of the second set of helical grooves.

7. A method of manufacturing a downhole wireline tool, comprising:

providing a rigid tool body;

forming a first set of helical grooves in an outer surface of the tool body;

deploying a first standoff ring about the tool body;

engaging the first set of helical grooves with the first standoff ring such that relative axial motion of the tool body in a first direction with respect to the first standoff ring causes the first standoff ring to rotate about the tool body in a clockwise direction;

forming a second set of helical grooves in the outer surface of the tool body;

deploying a second standoff ring about the tool body; and engaging the second set of helical grooves with the second standoff ring such that relative axial motion of the tool body in the first direction with respect to the second standoff ring causes the second standoff ring to rotate about the tool body in a counterclockwise direction.

8. The method of claim 7, comprising:

forming three or more sets of helical grooves in the outer surface of the tool body;

deploying three or more standoff rings about the tool body; and engaging the three or more sets of helical grooves with the three or more standoff rings such that adjacent ones of the three or more standoff rings are configured to rotate in opposite directions with respect to the tool body.

9. The method of claim 7, comprising providing a stop mechanism configured to prevent the first and second standoff rings translating out of engagement with the first and second sets of helical grooves.

10. The method of claim 7, comprising:

providing a third set of helical grooves disposed in an inner surface of the first standoff ring, wherein the third set of helical grooves is configured to engage the first set of helical grooves in the outer surface of the tool body; and providing a fourth set of helical grooves disposed in an inner surface of the second standoff ring, wherein the fourth set of helical grooves is configured to engage the second set of helical grooves in the outer surface of the tool body.

11. The method of claim 7, comprising:

providing a first biasing mechanism disposed in the first standoff ring, wherein the first biasing mechanism is configured to bias the first standoff ring towards a first end of the first set of helical grooves; and providing a second biasing mechanism disposed in the second standoff ring, wherein the second biasing mechanism is configured to bias the second standoff ring towards a first end of the second set of helical grooves.

12. A method of using a downhole wireline tool, comprising:

disposing a rigid tool body in a borehole;

contacting a first standoff ring deployed about the tool body with a wall of the borehole, wherein the first standoff ring is engaged with a first set of helical grooves in an outer surface of the tool body;

contacting a second standoff ring deployed about the tool body with the wall of the borehole, wherein the second standoff ring is engaged with a second set of helical grooves in the outer surface of the tool body;

applying an axial force to the tool body in a first direction with respect the first and second standoff rings to move the tool body in the first direction;

rotating the first standoff ring about the tool body in a clockwise direction; and rotating the second standoff ring about the tool body in a counterclockwise direction.

13. The method of claim 12, comprising:

contacting a three or more standoff rings deployed about the tool body with the wall of the borehole, wherein the three or more standoff rings are engaged with three or more sets of helical grooves in the outer surface of the tool body; and rotating the three or more standoff rings about the tool body such that adjacent ones of the three or more standoff rings rotate in opposite directions with respect to the tool body.

14. The method of claim 12, comprising preventing the first and second standoff rings translating out of engagement with the first and second sets of helical grooves using a stop mechanism.

15. The method of claim 12, comprising:

engaging a third set of helical grooves disposed in an inner surface of the first standoff ring with the first set of helical grooves in the outer surface of the tool body; and engaging a fourth set of helical grooves disposed in an inner surface of the second standoff ring with the second set of helical grooves in the outer surface of the tool body.

16. The method of claim 12, comprising:

biasing the first standoff ring towards a first end of the first set of helical grooves using a first biasing mechanism disposed in the first standoff ring; and biasing the second standoff ring towards a first end of the second set of helical grooves using a second biasing mechanism disposed in the second standoff ring.

* * * * *